United States Patent [19]

Sato et al.

[11] Patent Number: 4,741,577

[45] Date of Patent: May 3, 1988

[54] DOUBLE RANGING DRUM CUTTER HAVING LOAD CONTROLLER

[75] Inventors: Koji Sato, Chiba; Hiroshi Kuroda, Omuta; Ryuji Yamada, Omuta; Mamoru Serino, Omuta, all of Japan

[73] Assignees: Zaidan Hojin Sekitan Gijutsu Kenkyusho; Mitsui Sekitan Kogyo Kabushiki Kaisha; Kabushiki Kaisha Mitsui Miike Seisakusho, all of Tokyo, Japan

[21] Appl. No.: 911,168

[22] Filed: Sep. 24, 1986

Related U.S. Application Data

[63] Continuation-in-part of Ser. No. 703,268, Feb. 20, 1985, abandoned.

[30] Foreign Application Priority Data

Feb. 24, 1984 [JP] Japan ..... 59-32687

[51] Int. Cl.[4] ..... E21C 27/02

[52] U.S. Cl. ..... 299/1; 299/42; 173/6; 173/11

[58] Field of Search ..... 299/1, 42, 43, 30; 173/4, 6, 11

[56] References Cited

U.S. PATENT DOCUMENTS

| | | | |
|---|---|---|---|
| 3,323,839 | 6/1967 | Addison et al. | 299/1 |
| 4,269,448 | 5/1981 | Wilson | 229/1 |
| 4,470,635 | 9/1984 | Paarat et al. | 299/1 |
| 4,591,209 | 5/1986 | Droscher et al. | 299/1 |

FOREIGN PATENT DOCUMENTS

| | | | |
|---|---|---|---|
| 2027548 | 2/1980 | United Kingdom | 299/1 |
| 2133063 | 7/1984 | United Kingdom | 299/1 |

*Primary Examiner*—James A. Leppink
*Assistant Examiner*—Terry Lee Melius
*Attorney, Agent, or Firm*—George B. Oujevolk

[57] ABSTRACT

According to the applicant's invention a load detector is used, in which a load sensor and a vibration sensor are combined using an AND gate. A load signal from the load detector is used for the feedback control of the cutter drum height and double ranging drum cutter running speed, so that a person who is not skilled can operate the double ranging drum cutter while preventing overload acting on the cutter drum.

1 Claim, 8 Drawing Sheets

LOAD CONTROL FLOW CHART

DOUBLE RANGING DRUM CUTTER HAVING LOAD CONTROLLER

This application is a continuation-in-part of application Ser. No. 703,268 filed Feb. 20, 1985 now abd.

BACKGROUND OF THE INVENTION

This invention relates to a double ranging drum cutter having a load controller, in which the height and running speed of a cutter drums in a double ranging drum cutter used for long wall type coal extraction are automatically controlled such as to prevent overload on the cutter drums.

Description of the Prior Art

In the long wall type coal extraction arrangement of the prior art with a double ranging drum cutter, the operator judges the state of the load on the cutter drum from the vibrations and noise of the drum cutter body and sparks of contact of the drum cutter body with bedrock produced when the cutter drum is cutting the bedrock in contact therewith, and controls the height of the cutter drum and running speed of the double ranging drum cutter in an atmosphere containing floating mine dust with the operator's five senses so that no excessive load is applied to the cutter drum. Therefore, the operation of the drum cutter requires considerable skill. Also, it is difficult to completely prevent the application of overload to the cutter drum.

OBJECTS OF THE INVENTION

A first object of the present invention is to provide a double ranging drum cutter, which comprises a drum cutter body, cutter drums provided on the opposite ends of the drum cutter body in the running direction thereof for controlling the height by drum height controllers, cutter head vibration measuring units mounted on the drum cutter body, a cutter motor load measuring unit mounted on the drum cutter body, and a controller mounted on the drum cutter body and with a control data setter connected to the controller, the cutter head vibration measuring units and cutter motor load measuring unit being connected to an input section of the controller, a running speed controller provided on the drum cutter body and drum height controllers being connected to an output section of the controller, and in which the load applied to the cutter drums is judged indirectly from the vibrations of the cutter head and motor load current during the cutting, and the height of the cutter drums and the running speed of the double ranging drum cutter are automatically controlled through feedback control, thus permitting ready operation of the double ranging drum cutter even by a person who is not skilled while reliably preventing overload applied to the cutter drums.

A second object of the present invention is to permit automatic operation of the double ranging drum cutter by the remote control while reliably preventing the application of overload to the cutter drums.

DETAILED DESCRIPTION OF THE PREFERRED EMBODIMENT

Figure 1:
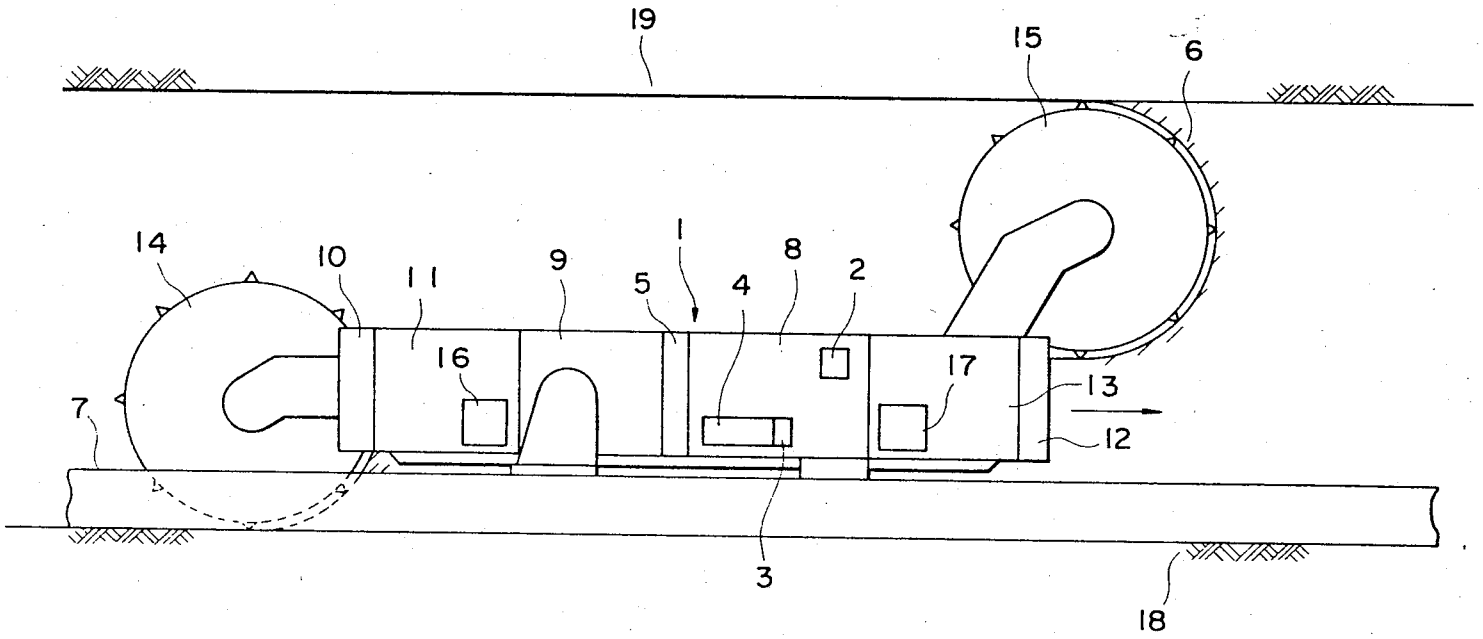
FIG. 1 is a side view showing an embodiment of the double ranging drum cutter having a load controller according to the inventive concept.

FIG. 1 shows a double ranging drum cutter having a load controller according to the present invention. A face conveyor 7 is provided on a lower bedrock 18 such that it extends in the longitudinal direction toward the front of a coal layer 6. A drum cutter body 1, which comprises a cutter motor section 8, a running speed controller 5, a haulage 9, a rear or left cutter assembly head 11 having a left drum height controller 10 and a front or right cutter assembly 13 having a right drum height controller 12, is mounted on the face conveyor 7 such that it is movable in the longitudinal direction of the conveyor. A left cutter drum 14 is supported for vertical movement by the left drum height controller 10, and a right cutter drum 15 is supported for vertical movement by the right drum heighth controller 12.

A controller 4 with a control data setter 3 connected thereto and a motor load measuring unit 2 are provided on the cutter motor section 8. A left cutter assembly vibration measuring unit 16 is provided on the left cutter assembly 11. A right cutter assembly vibration measuring unit 17 is provided on the right cutter assembly 13. The cutter motor load measuring unit 2 may be one, which senses the current in the cutter motor through a current transformer. Strain gauge type acceleration converters which can detect the acceleration in three directions, e.g. X, Y and Z, are used as the cutter head vibration measuring units 16 and 17. The vibration is measured from the detection signals for the three directions X, Y and Z in combination. The drum height controllers 10 and 12 are provided with motor-driven lifters.

Referring to FIG. 1, the double ranging drum cutter runs in the direction of arrow under the guide of the face conveyor. The left cutter drum 14 cuts in the coal layer 6 in the lower bedrock 18, and the right cutter drum 15 cuts in the coal layer 6 in an upper bedrock 19.

Figure 2:
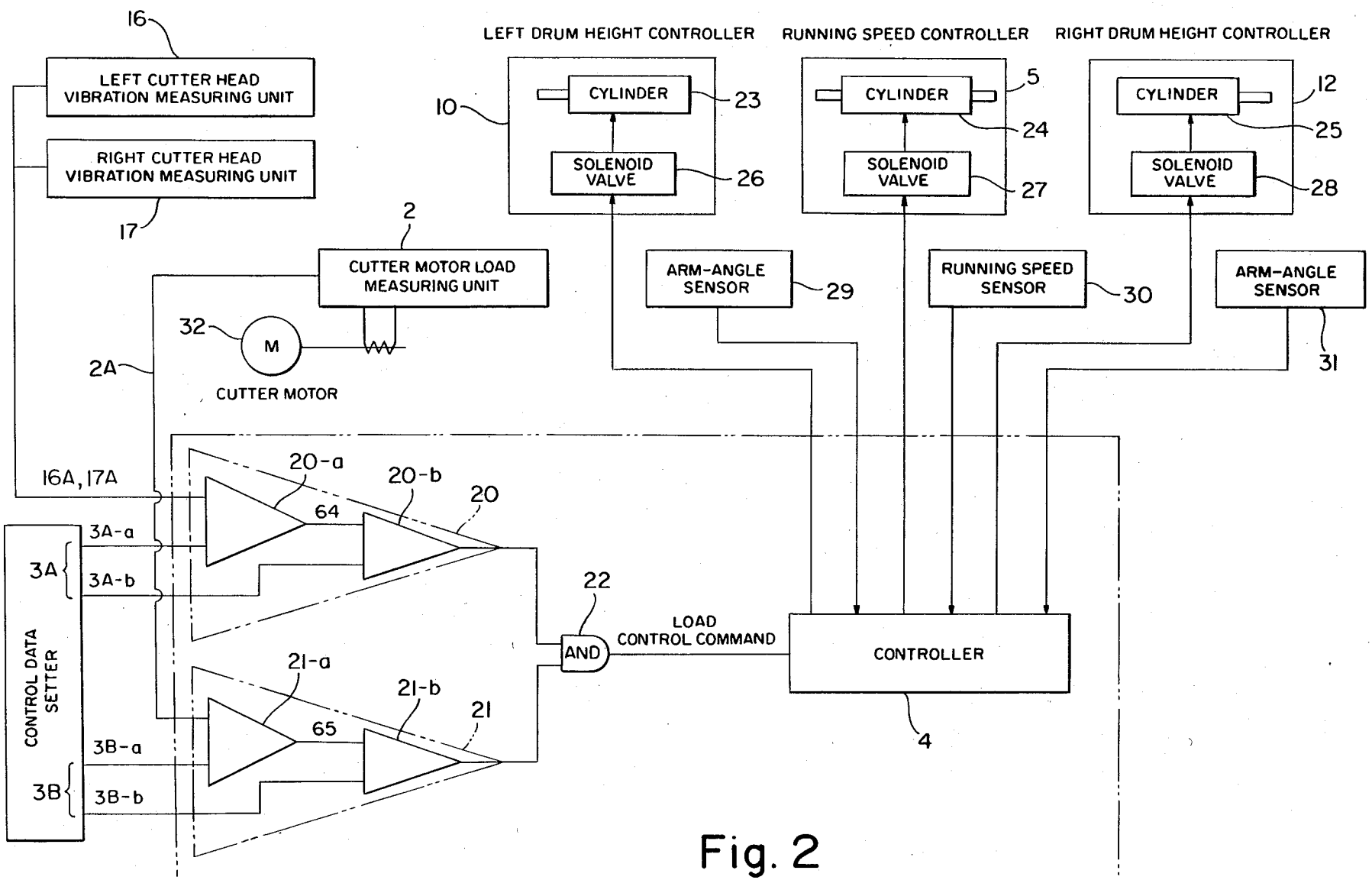
FIG. 2 is a simplified block diagram showing a control circuit.

FIG. 2 shows a load control circuit. The circuit includes the controller 4 with the control data setter 3 connected thereto. The left cutter assembly vibration measuring unit 16, right cutter assembly vibration measuring unit 17 and cutter motor load measuring unit 2 are connected to an input section of the controller 4. An output section of the controller 4 is connected to the running speed controller 5, left drum height controller 10 and right drum height controller 12. The controller circuit is formed by comparators 20 and 21, an AND gate 22, and the controller 4. A cutter motor load is supplied from a power source for a cutter motor 32 through a cutter motor load measuring unit 2 to a controller 4. Also vibration information is supplied from left and right cutter head vibration measuring units 16 and 17. The controller 4 compares these input values to data set by a control data setter 3. When the controller 4 determines that there is an overload, it provides a speed control signal for a running speed controller 5.

The controller 4 controls the running speed while supervising data from a running speed sensor 30.

The running speed controller 5, which receives the speed control signal from the controller 4, operates a solenoid valve 27 for controlling the oil hydraulic circuit. The oil hydraulic circuit thus operates a cylinder 24, so that the cutter speed is controlled by the cylinder 24.

Further, left and right drum height controllers 10 and 12 for controlling the drum height are connected to the controller 4. These controllers 10 and 12 are each provided with solenoid valve 26, 28 and cylinder 23, 25 for controlling the oil hydraulic circuit. Further, an arm angle sensor 29, 31 for detecting the drum height is connected to the controller 4, so that the drum height is controlled in the same manner as in the control of the running speed.

With the system shown it is possible to freely select one of three system i.e., (a) one for controlling the running speed, (b) one for controlling the drum height and (c) one for controlling both of the running speed and drum height.

Figure 3:
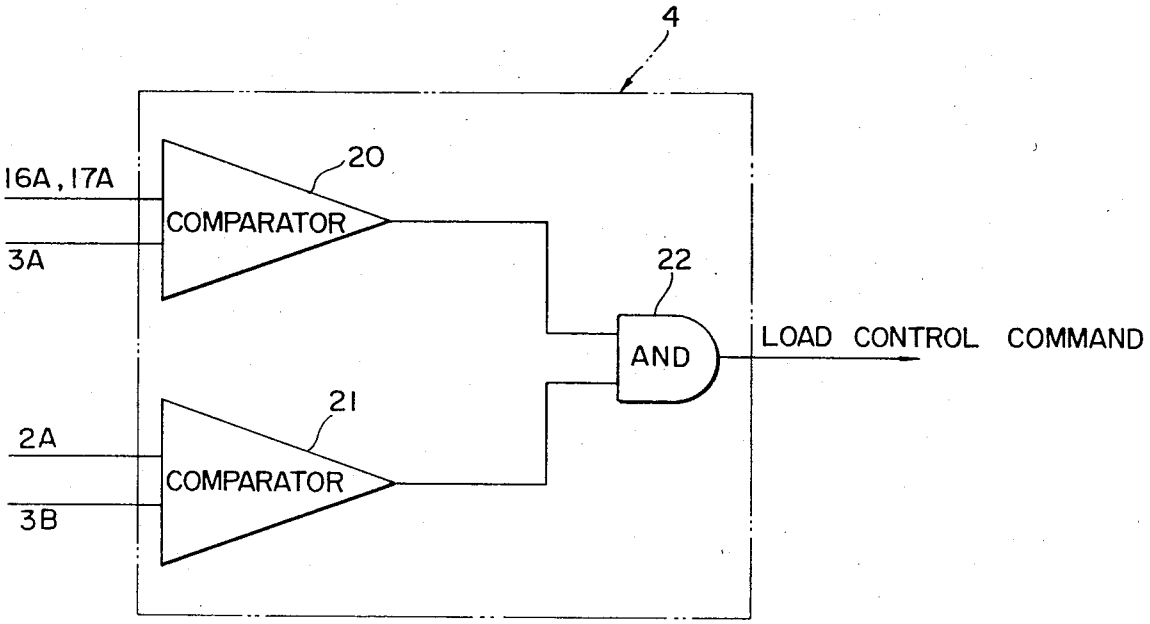
FIG. 3 is a circuit diagram showing a controller gating circuit.
Figure 4A:
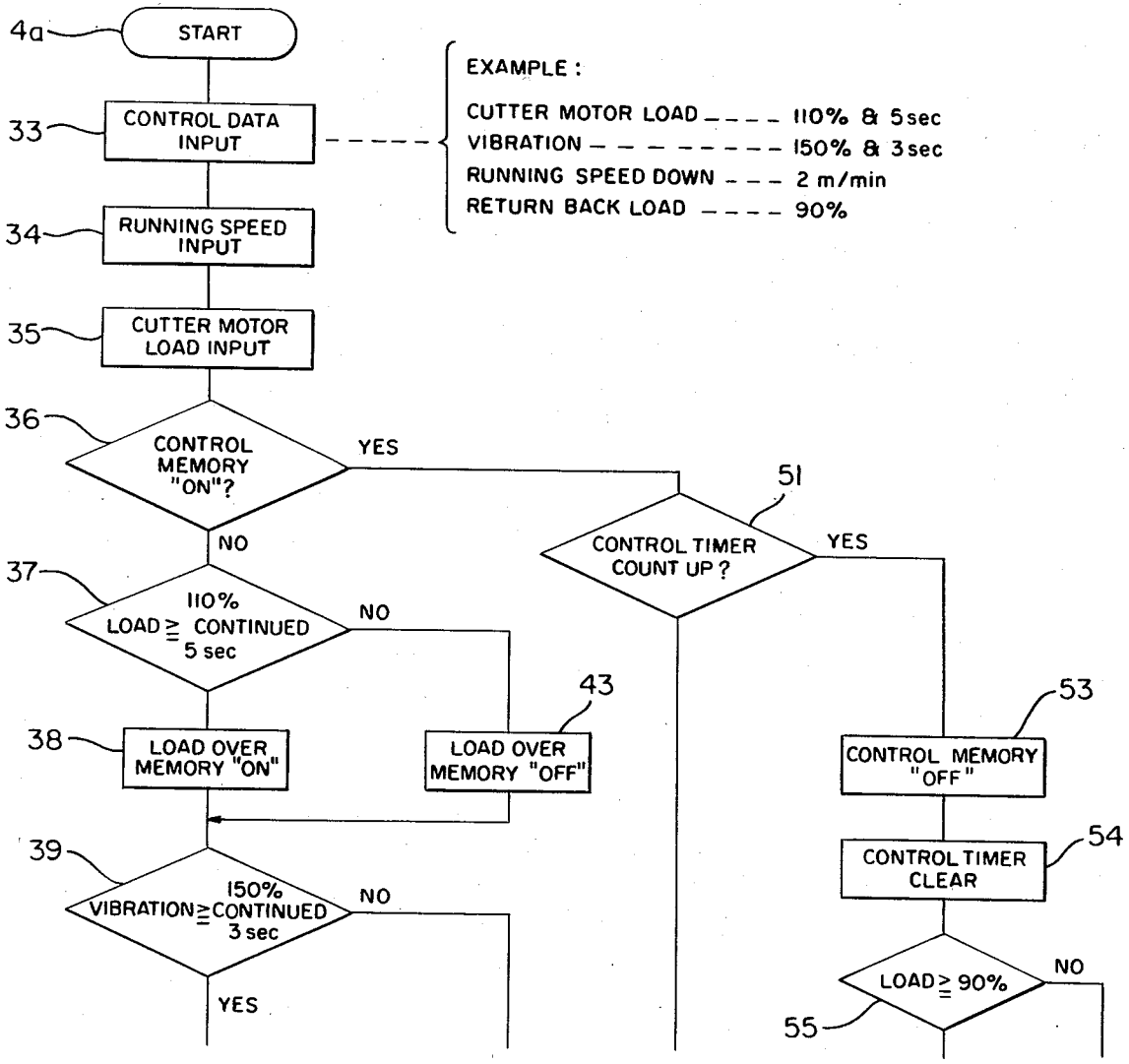
FIG. 4A and Fib. 4B are a block diagram load control flow chart, FIG. 4A being the top of the flow chart and FIG. 4B being the bottom of the load control flow chart.
Figure 4B:
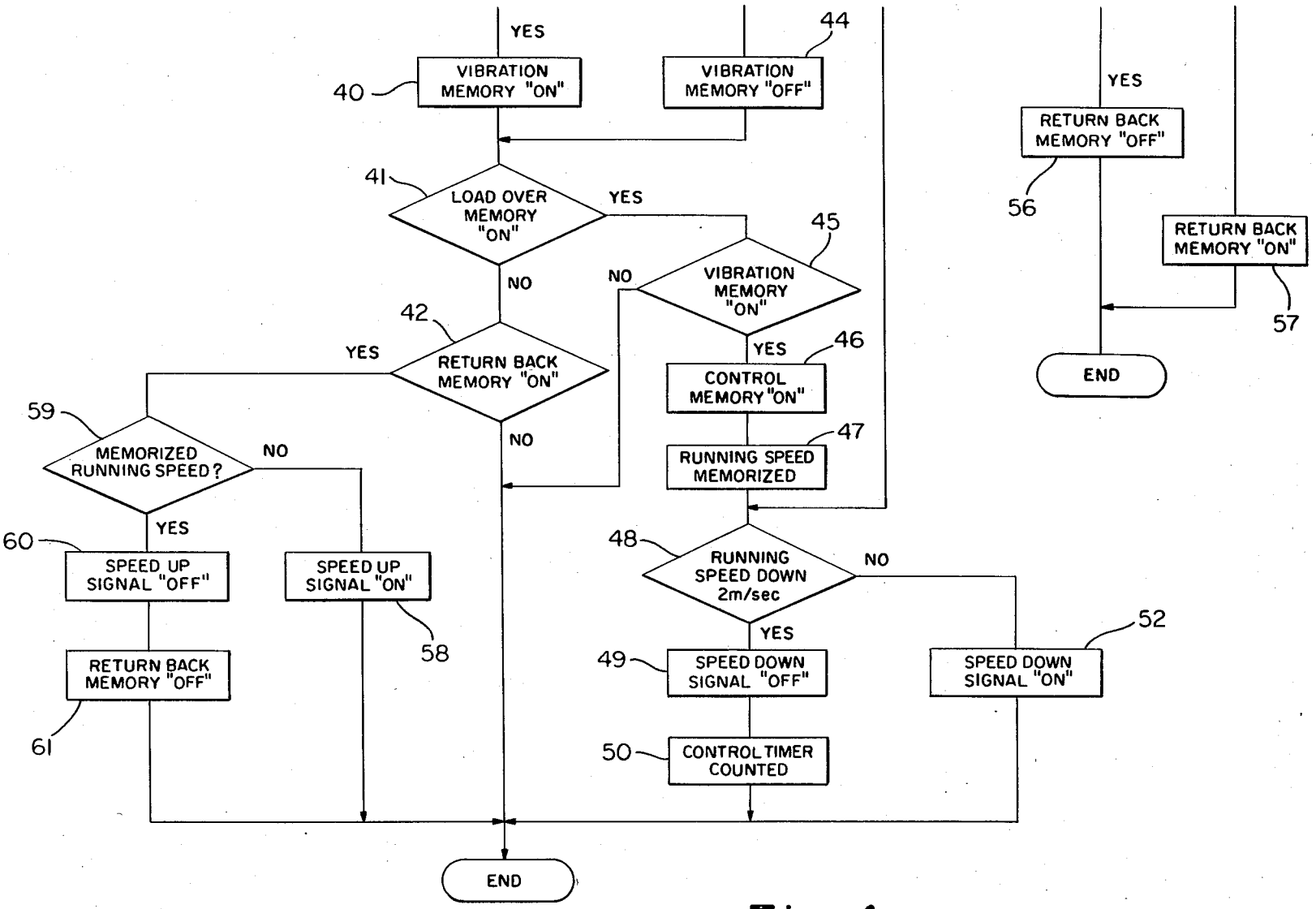

FIGS. 4A and 4B show an example of load control flow chart of the system shown in FIG. 3. In FIGS. 4A and 4B, control data input may be set as follows.

Cutter motor load: 110% & 5 sec. (indicating that the load is 110% or above continuously for 5 seconds).

Vibration: 150% & 3 sec. (indicating that the vibration is 150% or above continuously for 3 seconds).

Running speed down 2 m/min. (indicating that the speed is reduced stepwise at an interval of 2 m/min. in the control).

Return back load: 90% (indicating that speed up is adjusted if the load lever is reduced to be lower than 90% as a result of the control, while ending the control if the lever is above 90%).

The unit shown as controller 4 in FIG. 3 is made from commercially available components and has the following components:

a start switch 4*a*
control data input 33
running speed input 34
cutter motor load input 35
control memory ON 36
load continued input timer 37
load over memory ON 38
vibration continued timer 39
vibration memory 40
load over memory 41
return back memory ON 42
load over memory OFF 43
vibration memory OFF 44
vibration memory ON 45
control memory ON 46
running speed memorized 47
running speed down 48
speed down signal OFF 49
control timer counted 50
control timer count up 51
speed down signal ON 52
control memory OFF 53
control timer 54
load 55
return back memory OFF 56
return back memory ON 57
speed up signal ON 58
memorized running speed 59
speed up signal OFF 60
return back memory OFF 61

The following signal flow controls take place according to the magnitudes of the load current and vibrations:

I. Load current Preset value, Vibration Preset value START →33 →34 →35 →36 →37 →43 →39 →44 →41 →42 →END II. Load current Preset Value, Vibration Preset value START →33 →34 →35 →36 →37 →38 →39 →44 →41 →45 →END III. Load current Preset value, Vibration Preset value START →33 →34 →35 →36 →37 →43 →39 →40 →41 →42 →END IV. Load current Preset value, Vibration Preset value START →33 →34 →35 →36 →37 →38 →39 →40 →41 →45 →46 →47 →48 →52 →END V. The other functions items 53 through 61 are similar to the foregoing.

Thus, as shown in FIGS. 4A and 4B, the load that is applied to the cutter drums 14 and 15 when the coal layer 6 is being cut by the double ranging drum cutter of this embodiment, is detected by the vibration measuring units 16 and 17 mounted on the cutter assemblies 11 and 13 and motor load measuring unit 2. The controller 4 compares the detected load value and data that is set in the control data setter 3 according to the mechanical elements of the drum cutter and status of coal and bedrock and feedback controls the left drum height controller 10, right drum height controller 12 and running speed controller 5, whereby the load on the cutter drums is automatically controlled such as to prevent overload.

With reference to FIG. 3, the controller 4 also includes comparators 20 and 21. The comparator 20 compares the detection signals 16A and 17A from the cutter head vibration measuring units 16 and 17 and data signal 3A from the control data setter 3. The comparator 21 compares the detection signal 2A from the cutter motor load measuring unit 2 and data signal 3B from the control data setter 3. When an overload is detected, a load control command is fed through an AND gate 22 or OR gate to the left drum height controller 10, right drum height controller 12 and running speed controller 5, whereby the load is automatically controlled to prevent overload.

As herein before described, control data setter 3 includes a signal level setting function and a time setting function. When the time which exceeds the signal level setting value of the control data setter 3 has passed the setting time, the detection signals 2A, 16A and 17A are judged to be the state of overload, so that the load may be automatically controlled.

When it is believed that an overload is being applied to the lower cutter drum 14, more specifically, when the cutter drum 14 is cutting a relatively great amount of bedrock 18 having a large cutting resistance, the cutter arm 62 is rotated upwards to reduce the cutting ratio of the bedrock, so that the cutting resistance may be alleviated.

Further, if it is believed that the overload is applied to the upper cutter drum 15, more specifically, when the cutter drum 15 is cutting a relatively great amount of bedrock 19 having large cutting resistance, the cutter arm 63 is rotated downwards to reduce the cutting ratio of the bedrock so that the cutting ratio may be alleviated.

The controller 4 controls the running speed and the drum height by the load control command from the AND gate 22 as shown in FIG. 2.

Figure 5:
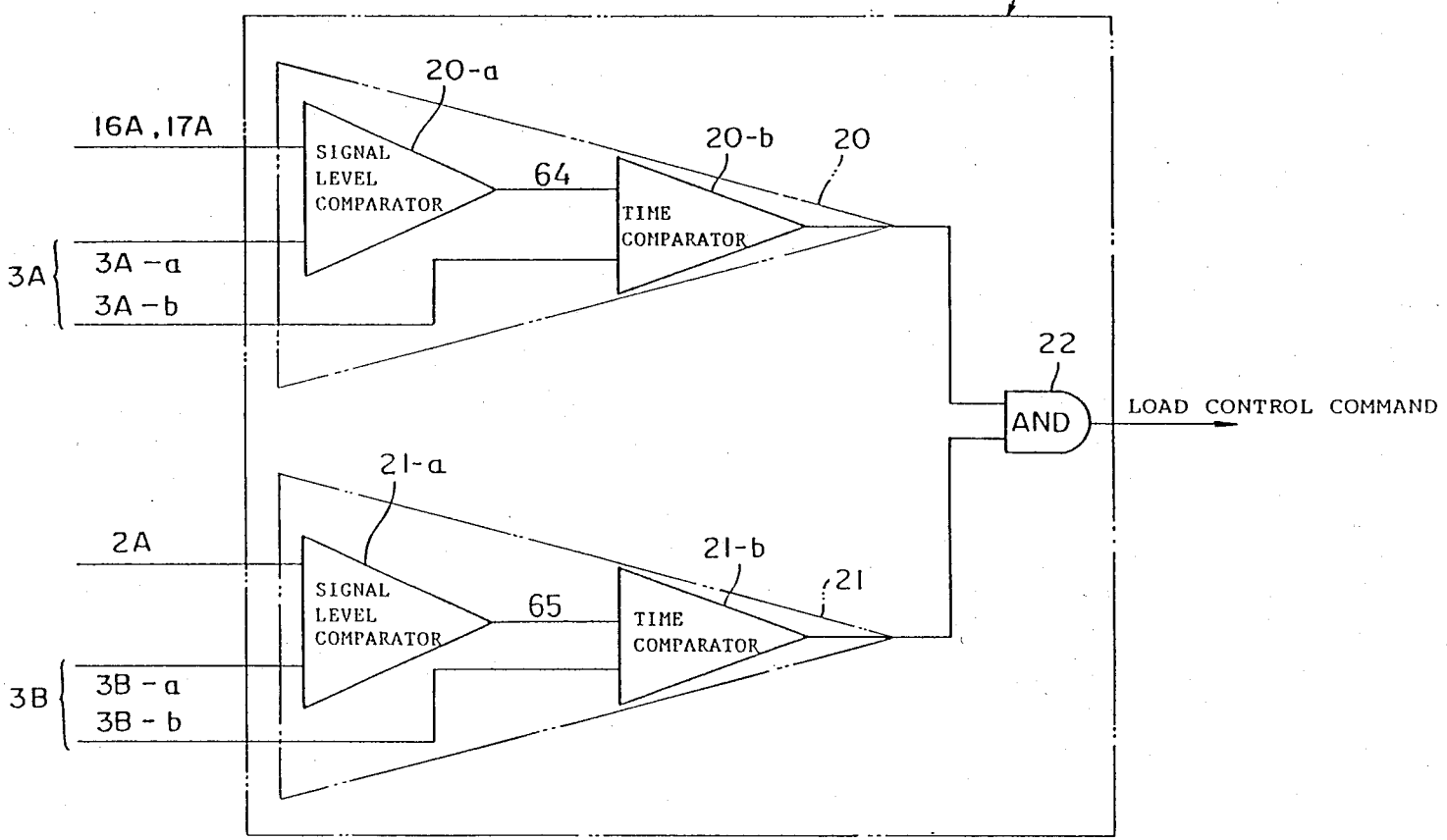
FIG. 5 is an enlarged view of FIG. 2.
Figure 6:
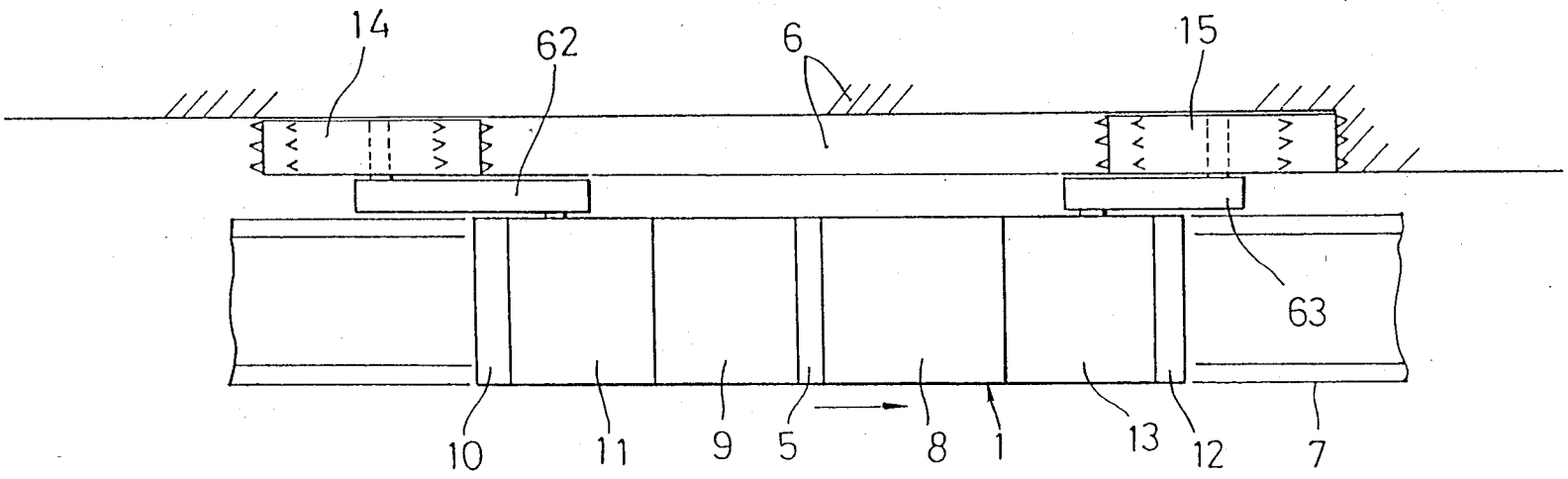
FIG. 6 is a plan view of FIG. 1.
Figure 7:
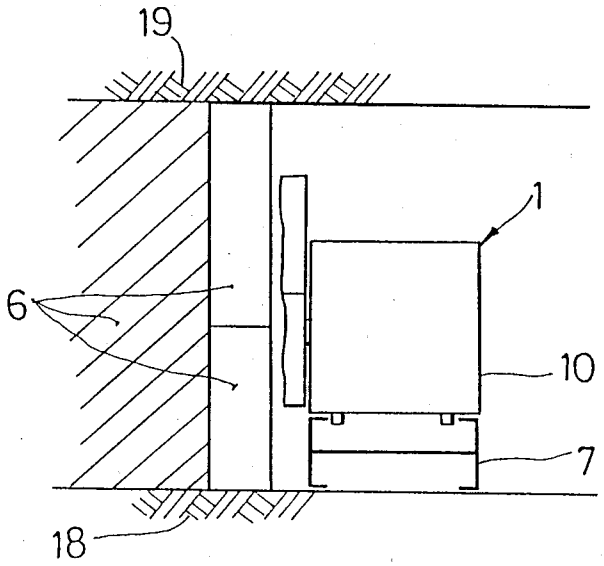
FIG. 7 shows a fragmentary left side view of FIG. 6.

More specifically, the overload state is judged by two functions, i.e., signal level setting function and time setting function. In this case, data signals 3A and 3B from the control data setter 3 include two signals respectively. One set of them are data signals 3A-*a* and 3B-*a* for level setting; and, the other set are data signals, 3A-*b* and 3B-*b* are for time setting. The comparator 20 in the controller 4 includes a signal level comparator 20-*a* and a time comparator 20-*b*. The comparator 21 in the controller 4 includes a signal level comparator 21-*a* and a time level comparator 21-*b*. These components are shown in FIG. 5. Output signals 64 and 65 detected by the signal level comparators 20-*a* and 21-*a* are compared with data signals 3A-*b* and 3B-*b* by means of the next stage time comparators 20-*b* and 21-*b*. When the signals exceed the setting of the data signals 3A-*b* and 3B-*b*, the judgement or conclusion is that the system is in a state of overload, so that the load may be controlled automatically.

It is to be observed therefore that the present invention provides an improvement in a double ranging drum cutter for moving along a face conveyor towards a coal layer and contemplates an elongated body 1 for moving along the face conveyor. This elongates body has a front and rear and a motor section 8. Front and rear cutter drums 14, 15 with adjustable cutter assemblies 11, 13 are at the front and rear. Also, front and rear drum height controllers 10, 12 are provided as well as front and rear cutter assembly vibration measuring means 16, 17 mounted on the body and coupled to the cutter assemblies. A motor load measuring unit 2 is mounted on the body and coupled to the motor section 8, also a running speed controller means 5. Also mounted on the body is a load controller 4 including a data setter 3. The running speed controller means 5, the drum height controllers 10, 11 are all connected to the load controller 4. Further, said load controller 4 has input and output sides, the vibration measuring units 16, 17 as well as the motor load measuring unit 2 being connected to the input side. Thus, the load controller 4 including first and second comparators 20, 21 receiving said inputs, the first comparator 20 receiving the input from the vibration measuring units 16, 17, a data signal 3A from the control data setter 3, the second comparator 21 receiving a signal from the motor load measuring unit 2 and a data signal 3B from the control data setter 3. A gate 22 is also connected to the first and second comparators 20, 21. This gate provides a command output to the front and rear height controllers 10, 11 and the running speed controller means 5 when an overload is detected.

What is claimed is:

1. An arrangement used in mining coal using a face conveyer leading to a coal layer, including a double ranging drum cutter for moving along the face conveyor towards the coal layer, comprising in combination:

(a) an elongated body for moving along the face conveyor, said body having a front and rear, also a motor section, at the center of said body;

(b) front and rear cutter drums with adjustable cutter assemblies at the front and rear of said body;

(c) front and rear drum height controllers for controlling the height of the cutter drums;

(d) front and rear cutter assembly vibration measuring means mounted on said body and coupled to said assemblies;

(e) a motor load meauring unit mounted on said body and coupled to the motor section;

(f) running speed controller means on said body;

(g) a load controller including a data setter mounted on said body, said running speed controller means, also the drum height controllers all being connected to said load controller, further, said load controller having input and output sides, the vibration measuring units as well as the motor load measuring unit being connected to said input side, said load controller including first and second comparators, the first comparator having a first signal level comparator for receiving the output from the vibration measuring units, and a data signal from the control data setter and a first time comparator for receiving the output from said first signal level comparator and a first time setting signal, the second comparator having a second level comparator for receiving a signal from the motor load measuring unit and a data signal from the control data setters, and a second time comparator for receiving the output from said second level comparator and a second time setting signal; and a gate connected to the first and second time comparators, said gate providing a command output to the front and rear height controllers and the running speed controller means when an overload is detected.

* * * * *